US011161682B2

(12) United States Patent
Rhoades et al.

(10) Patent No.: US 11,161,682 B2
(45) Date of Patent: Nov. 2, 2021

(54) DEVICE FOR PROVIDING A DISPOSABLE BAG IN KEG OR OTHER CONTAINER

(71) Applicant: Newco 4 LLC, Loveland, CO (US)

(72) Inventors: Peter William Rhoades, Fort Collins, CO (US); Michael Anthony Campana, Loveland, CO (US); William T. Beierwaltes, Loveland, CO (US)

(73) Assignee: Newco 4 LLC, Loveland, CO (US)

( * ) Notice: Subject to any disclaimer, the term of this patent is extended or adjusted under 35 U.S.C. 154(b) by 0 days.

(21) Appl. No.: 16/828,348

(22) Filed: Mar. 24, 2020

(65) Prior Publication Data

US 2020/0307898 A1 Oct. 1, 2020

Related U.S. Application Data

(60) Provisional application No. 62/824,511, filed on Mar. 27, 2019.

(51) Int. Cl.
*B67D 1/08* (2006.01)
*B65D 83/62* (2006.01)
(Continued)

(52) U.S. Cl.
CPC ..... *B65D 83/62* (2013.01); *B67D 1/045* (2013.01); *B67D 1/0801* (2013.01);
(Continued)

(58) Field of Classification Search
CPC .... B67D 2001/0093; B67D 2001/0828; B67D 1/045; B67D 1/0801; B67D 1/0831;
(Continued)

(56) References Cited

U.S. PATENT DOCUMENTS 209,244 A 10/1878 Gaffron
595,320 A 12/1897 Long
(Continued)

FOREIGN PATENT DOCUMENTS

CA 1121321 4/1982
CN 1735554 11/2003
(Continued)

OTHER PUBLICATIONS

International Search Report and Written Opinion in co-owned Patent Application No. PCT/US2020/24444 dated Jun. 19, 2020, 9 pages.

*Primary Examiner* — Charles P. Cheyney
(74) *Attorney, Agent, or Firm* — Trenner Law Firm, LLC; Mark D. Trenner

(57) ABSTRACT

A device for providing a disposable liner or bag and valve inside of a keg. An example device includes a valve assembly connected to a spear assembly. The disposable liner or bag is wrapped around the spear assembly to fit through a top opening in the keg and the valve assembly is connected to the top opening of the keg. A series of valves and passages enable an inert gas to flow into and expand or inflate the disposable liner or bag inside of the keg, and the valve then enables filling the disposable liner or bag inside of the keg with beer or other liquid to be dispensed from the keg. When the keg is empty, the spear assembly may be disconnected and withdrawn, thus removing both the disposable liner or bag and disposable valve assembly from the keg.

18 Claims, 12 Drawing Sheets

(51) Int. Cl.
*B67D 1/04* (2006.01)
*B67D 1/00* (2006.01)

(52) U.S. Cl.
CPC .... *B67D 1/0831* (2013.01); *B67D 2001/0093* (2013.01); *B67D 2001/0828* (2013.01)

(58) Field of Classification Search
CPC .. B67D 1/0832; B67D 1/0462; B67D 1/0838; B65D 11/06; B65D 77/06; B65D 7/045; B65D 83/62; Y10T 137/314; Y10T 137/6137
USPC ..... 222/94, 95, 105, 386.5, 400.7
See application file for complete search history.

(56) References Cited

U.S. PATENT DOCUMENTS

| | | | | | |
|---|---|---|---|---|---|
| 2,991,916 | A | | 7/1961 | Kish | |
| 3,353,724 | A | * | 11/1967 | Johnston | B67D 1/0832 222/400.7 |
| 3,608,790 | A | | 9/1971 | Johnston | |
| 3,610,478 | A | | 10/1971 | Johnston | |
| 3,776,260 | A | * | 12/1973 | Ruddick | B67D 1/0832 137/321 |
| 4,150,771 | A | * | 4/1979 | Golding | B67D 1/0832 137/212 |
| 4,509,663 | A | | 4/1985 | Fallon | |
| 4,612,952 | A | | 9/1986 | Fallon | |
| 4,665,940 | A | * | 5/1987 | Jacobson | B65D 83/425 137/212 |
| D326,503 | S | | 5/1992 | Ipsen | |
| D326,609 | S | | 6/1992 | Stenger | |
| D328,200 | S | | 7/1992 | Ipsen | |
| D334,345 | S | | 3/1993 | Wright | |
| D338,594 | S | | 8/1993 | Stenger | |
| 5,242,092 | A | | 9/1993 | Riis | |
| D342,028 | S | | 12/1993 | Stenger | |
| D365,757 | S | | 1/1996 | Stenger | |
| 5,499,758 | A | * | 3/1996 | McCann | B67D 1/045 222/386.5 |
| 5,595,208 | A | | 1/1997 | Augustinus | |
| 5,901,747 | A | | 5/1999 | Rokkjaer | |
| 5,957,328 | A | * | 9/1999 | Osgar | B67D 7/344 222/1 |
| 6,308,869 | B1 | | 10/2001 | Simpson | |
| 6,367,667 | B1 | | 4/2002 | Ipsen | |
| 6,729,758 | B1 | | 5/2004 | Carter | |
| 7,111,442 | B1 | * | 9/2006 | Van Baal | B65D 77/06 53/473 |
| D552,907 | S | | 10/2007 | Johnson | |
| D562,066 | S | | 2/2008 | Baker | |
| 7,604,147 | B2 | | 10/2009 | Anderson | |
| 7,810,679 | B2 | | 10/2010 | Wauters et al. | |
| 7,828,173 | B2 | * | 11/2010 | Geier | B65D 83/62 222/105 |
| 8,561,856 | B2 | | 10/2013 | Kuperus | |
| 8,684,026 | B2 | * | 4/2014 | Rundin | B67D 1/0832 137/322 |
| 8,777,056 | B2 | * | 7/2014 | Bates | B67D 1/0406 222/1 |
| 8,800,815 | B1 | | 8/2014 | Butler et al. | |
| D769,064 | S | | 10/2016 | Crowell | |
| D776,971 | S | | 1/2017 | Crowell | |
| D797,261 | S | | 9/2017 | Crowell | |
| 9,834,428 | B2 | | 12/2017 | Dahl | |
| 10,370,237 | B2 | * | 8/2019 | Blackburn | B67D 1/0462 |
| D858,705 | S | | 9/2019 | Jørgensen | |
| D862,646 | S | | 10/2019 | Jørgensen | |
| 2002/0179157 | A1 | | 12/2002 | Rokkjaer | |
| 2006/0118574 | A1 | | 6/2006 | Anderson et al. | |
| 2008/0061258 | A1 | | 3/2008 | Grimwade | |
| 2009/0184133 | A1 | * | 7/2009 | Hasegawa | B67D 7/0261 222/95 |
| 2009/0211647 | A1 | | 8/2009 | Anderson et al. | |
| 2009/0320264 | A1 | | 12/2009 | Berger et al. | |
| 2010/0018994 | A1 | | 1/2010 | Antheil et al. | |
| 2010/0102087 | A1 | * | 4/2010 | Meike | B67D 1/0462 222/105 |
| 2012/0104035 | A1 | * | 5/2012 | Bates | B67D 1/0884 222/386.5 |
| 2015/0284235 | A1 | | 10/2015 | Blackburn | |
| 2015/0368084 | A1 | | 12/2015 | Apps | |
| 2016/0137478 | A1 | | 5/2016 | Riis | |
| 2016/0221815 | A1 | | 8/2016 | Riis | |

FOREIGN PATENT DOCUMENTS

| | | | |
|---|---|---|---|
| CZ | 287474 | B6 | 12/2000 |
| EP | 1873069 | | 1/2008 |
| GB | 2005786 | | 4/1979 |
| RU | 2346882 | | 2/2009 |
| WO | WO1995023112 | | 8/1995 |
| WO | WO2019038331 | A1 | 2/2019 |
| WO | WO2019110714 | A1 | 6/2019 |
| WO | WO2020198217 | A1 | 10/2020 |

* cited by examiner

DEVICE FOR PROVIDING A DISPOSABLE BAG IN KEG OR OTHER CONTAINER

PRIORITY CLAIM

This application claims the priority benefit of U.S. Provisional Patent Application No. 62/824,511 filed Mar. 27, 2019 for "Device For Providing A Disposable Bag In Keg Or Other Container," of Rhoades, et al., hereby incorporated by reference in its entirety as though fully set forth herein.

BACKGROUND

A keg is typically made of stainless steel (but may also be made of aluminum or other material) and used to store, transport, and dispense alcoholic beverages such as beer, or other liquid (e.g., cooking oil). A keg may have a single opening on the top, often referred to as a "neck." A tube-like structure referred to as a "spear" is provided in the opening and extends to the bottom of the keg, to dispense the beer or other liquid.

A keg may include a self-closing valve that is opened by a coupling fitting attached when the keg is "tapped." Another opening at the top of the spear provides a path for gas (e.g., carbon dioxide) to enter the keg and push the beer or other liquid out of the keg for dispensing. One or more valve(s) may be provided to control flow of the beer or other liquid during dispensing. Gas may be provided into the keg as the beer or other liquid is dispensed.

Kegs need to be thoroughly cleaned before refilling, or the keg may become a host for a variety of bacteria, some harmful. It is recommended that the kegs and spears are cleaned using hot water (e.g., 120° F.), steam and other caustic and acidic materials. The spears can be cleaned manually by soaking in caustic, then scrubbing and brushing. The kegs may be filled and allowed to soak overnight with a dilute caustic solution to clean the interior. It is important to avoid excess contact time with chlorine, which can corrode stainless steel.

Looking inside of the kegs after cleaning is the best method to verify the cleaning process. However, this can be difficult, given the small size of the opening and non-transparent materials the keg is made of.

DETAILED DESCRIPTION

Figure 1:
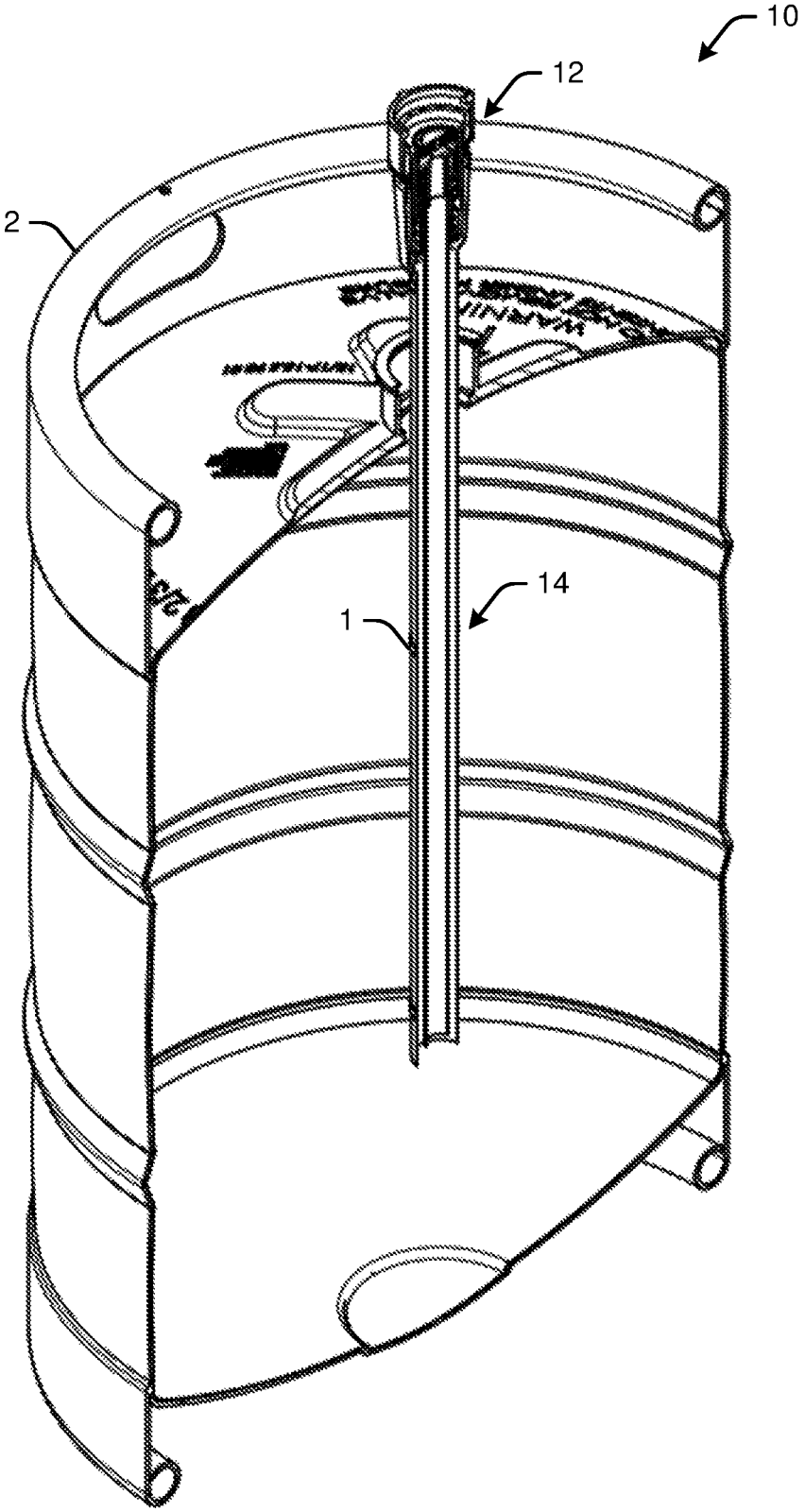
FIG. 1 shows an example device for providing a disposable liner or bag and valve inside of a keg or other container.

A device for providing a disposable "liner" or "bag" and valve inside of a keg or other container is disclosed. As used herein, the terms "liner" and "bag" are used interchangeably and have the same meaning. In an example, the device is made for industry standard kegs without modification. In other examples, the device may be modified for other keg types.

In an example, the device may include a valve assembly. The valve assembly may connect to a spear assembly. The disposable liner or bag may be provided on the spear assembly. The device can be configured to fit entirely through the neck of industry-standard kegs (e.g., having replaceable and/or maintainable spear valve assemblies), without any modification to the keg itself. Air vent openings may be provided in the device to enable ambient air to pass in and out of the space between the liner or bag and keg wall.

In an example, the disposable liner or bag is wrapped or otherwise folded on or around the spear assembly so that the liner or bag fits through the top opening of the keg and can be inserted therethrough.

The valve assembly can then be connected to the top opening of the keg. A series of valves and passages enable an inert gas (e.g., carbon dioxide) to flow into and expand or inflate the disposable liner or bag and valve inside of the keg. The valve assembly also enables filling the disposable liner or bag and valve inside of the keg with beer or other liquid.

In use, the valve assembly enables dispensing the beer or other liquid from the container. Vent openings or holes in the body of the valve assembly (providing passage to the outside of the keg) allow the volume inside the keg on the outside of the liner or bag (between the liner or bag and the inside keg wall) to shrink or expand during dispensing, as needed. That is, the valve assembly allows air between the liner or bag and the keg interior to transfer to (or recapture from the outside atmosphere) as required during inflation or deflation. This feature eliminates the tendency for static pressure to build between the keg wall and liner or bag which would otherwise prohibit proper inflation or create a vacuum which would otherwise prohibit deflation of the liner or bag against the rigid shell.

When the keg is empty, the spear assembly may be disconnected from the top opening of the keg and withdrawn, thus removing the disposable liner or bag.

The device provides an alternative to traditional methods of cleaning kegs or other containers. In an example, both the liner or bag and keg valve are provided together so that they both can be cleaned or disposed of together. The design of the device is very efficient (e.g., lowest cost), enabling it to be provided with competitive pricing.

By providing disposable liners or bags and disposable keg valves for use with the keg, the beer or other liquid is always provided in a clean or sterile containment area within the keg, and dispensed in a clean or sterile dispenser from the keg, regardless of the cleanliness of the inside of the keg. The liner or bag also serves as a barrier between the beer or other liquid, and the inside walls of the keg. This may reduce or altogether prevent the growth of bacteria within the keg, and reduce or altogether eliminate the need to otherwise clean the inside of the keg (thus exposing the stainless steel to caustic solution). This may result in a safer, cleaner keg, without the need for time-consuming cleaning, and may also enhance product safety, shelf-life, and product taste.

The device reduces or altogether eliminates bacteria, cleaning issues (e.g., risks, labor, personnel training, inconsistent quality or spoilage from external or other agents). The device also eliminates cleaning materials such as caustic, acidic and sterilization chemicals. The device reduces or eliminates expenses such as materials, labor and overhead associated with cleaning the kegs. The device also reduces or eliminates cross-contamination when moving from one type of keg content to another (e.g., beer, to wine, to juice, etc.). The device also reduces or eliminates spear-valve breakdown problems due to long use. That is, with every use, a new liner or bag and spear valve can be provided for each use. The device also reduces or eliminates air mixing with the beer that can spoil beer or other contents of the keg, change its taste, and/or reduce shelf life of the product stores in the keg.

In an example, the design incorporates (and device supplied with) a replacement internal retaining ring "snap ring" that significantly reduces the tools and labor required for removal and installation of the ring before and after the valve.

Before continuing, it is noted that as used herein, the terms "includes" and "including" mean, but is not limited to, "includes" or "including" and "includes at least" or "including at least." The term "based on" means "based on" and "based at least in part on."

Figure 10:
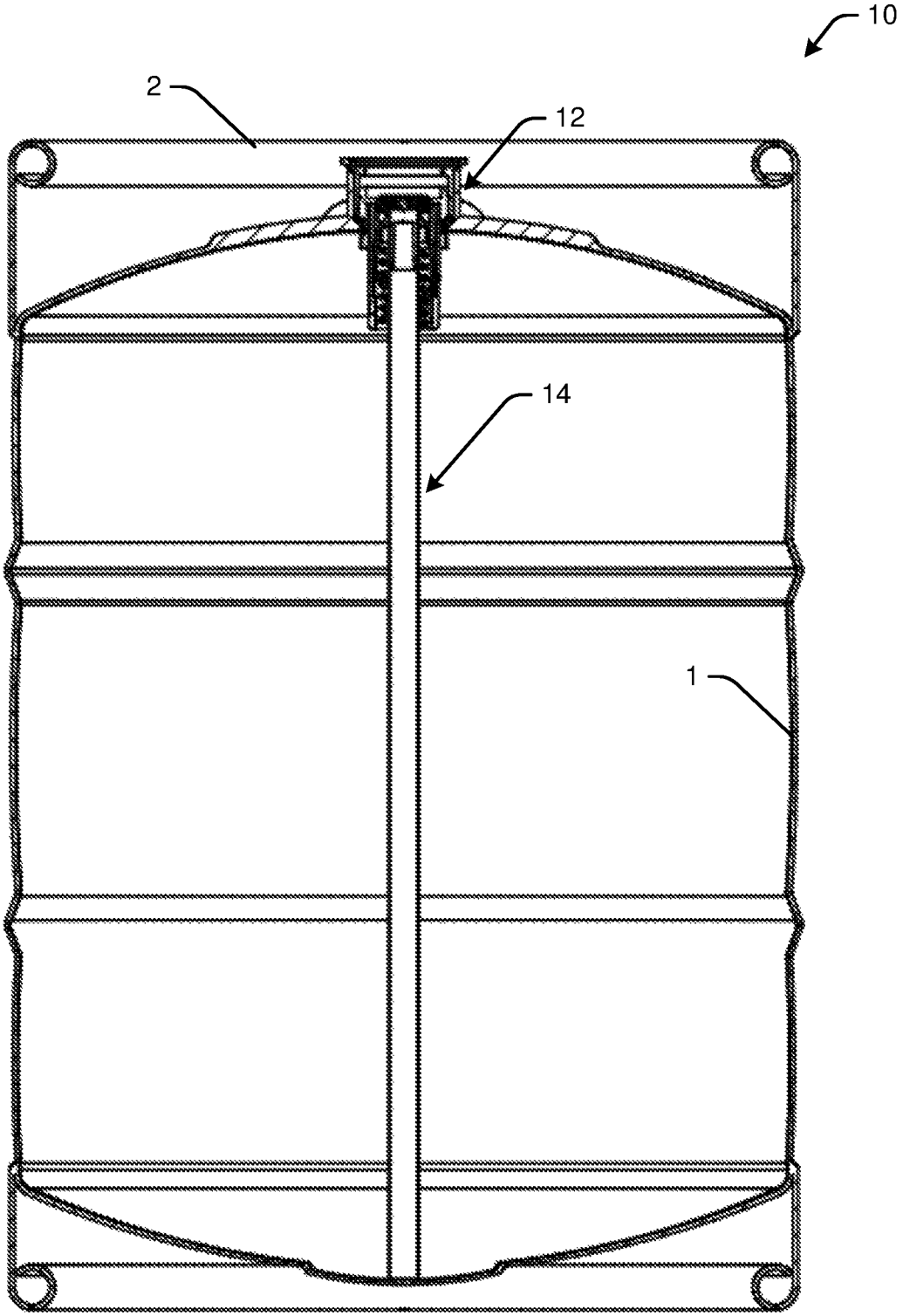

FIG. 1 shows an example device 10 for providing a disposable liner or bag 1 (see also, for example FIG. 10) and valve inside of a keg 2 or other container. In an example, the device 10 for providing a disposable liner or bag 1 and valve inside of a keg 2 or other container includes a valve assembly 12 for attachment to a Sankey style or other suitable coupler. The example device 10 also includes a spear assembly 14 connected to the valve assembly 12. A disposable liner or bag 1 may be provided on the spear assembly 14, such that the disposable liner or bag 1 is wrapped or otherwise folded on or around the spear assembly 14 so that the liner or bag 1 fits through the top opening of the keg 2 and can be inserted therethrough.

Figure 2:
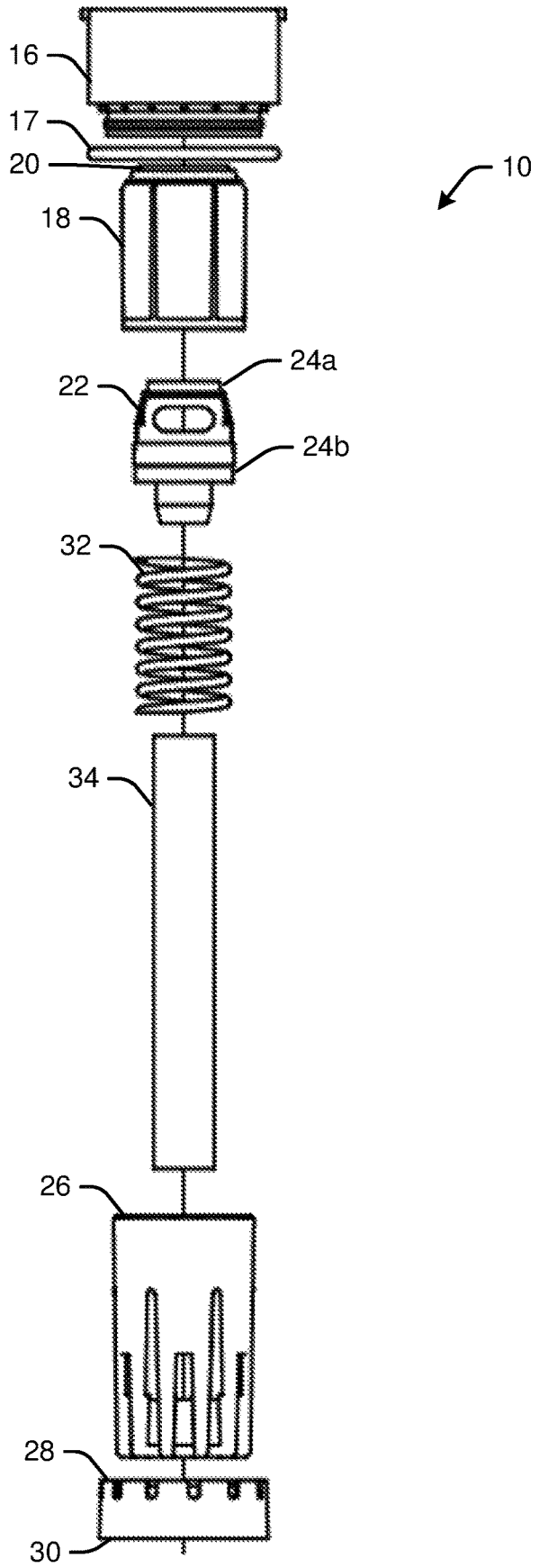
FIG. 2 is an exploded component view of the example device for providing a disposable liner or bag and valve inside of a keg or other container.

FIG. 2 is an exploded component view of the example device 10 for providing a disposable liner or bag 1 (see FIG. 1) and valve inside of a keg 2 or other container. In an example, the valve assembly 12 includes a body 16 with o-ring 17 for seating on a keg 2. The body also provides a fitting to a Sankey coupler. The Sankey coupler provides a valve lever outside of the keg 2 or other container to actuate the valve assembly 12.

The valve assembly 12 includes a secondary valve 18 mounted inside the body 16 of the valve assembly 12. A matched seat seals against a secondary valve seal 20 for the secondary valve 18. A poppet valve 22 is provided inside the secondary valve 18. The poppet valve has a provision that is selected between the secondary valve 18 and the poppet valve 22.

A poppet valve upper seal 24*a* is provided between the secondary valve and the poppet valve. A poppet valve lower seal 24*b* is provided between the poppet valve outside diameter and the internal diameter of the secondary valve. The spring is housed and piloted in a cage adjacent to a bag fitment.

In an example, the valve assembly 12 also includes a cage 26 mounting over the secondary valve 18, and a bag fitment 28 on the keg 2 or other container. The disposable liner or bag 1 is connected to the bag fitment 28. A fitment seal 30 seals the bag and fitment to the valve body 16. A spring 32 is housed or piloted between the cage 26 and the poppet valve 22 adjacent to the bag fitment 28. A dispensing tube 34 connects through the bag fitment 28, the cage 26, and onto the poppet valve 22.

Before continuing, it should be noted that the examples described above are provided for purposes of illustration, and are not intended to be limiting. Other devices and/or device configurations may be utilized to carry out the operations described herein.

Figure 3:
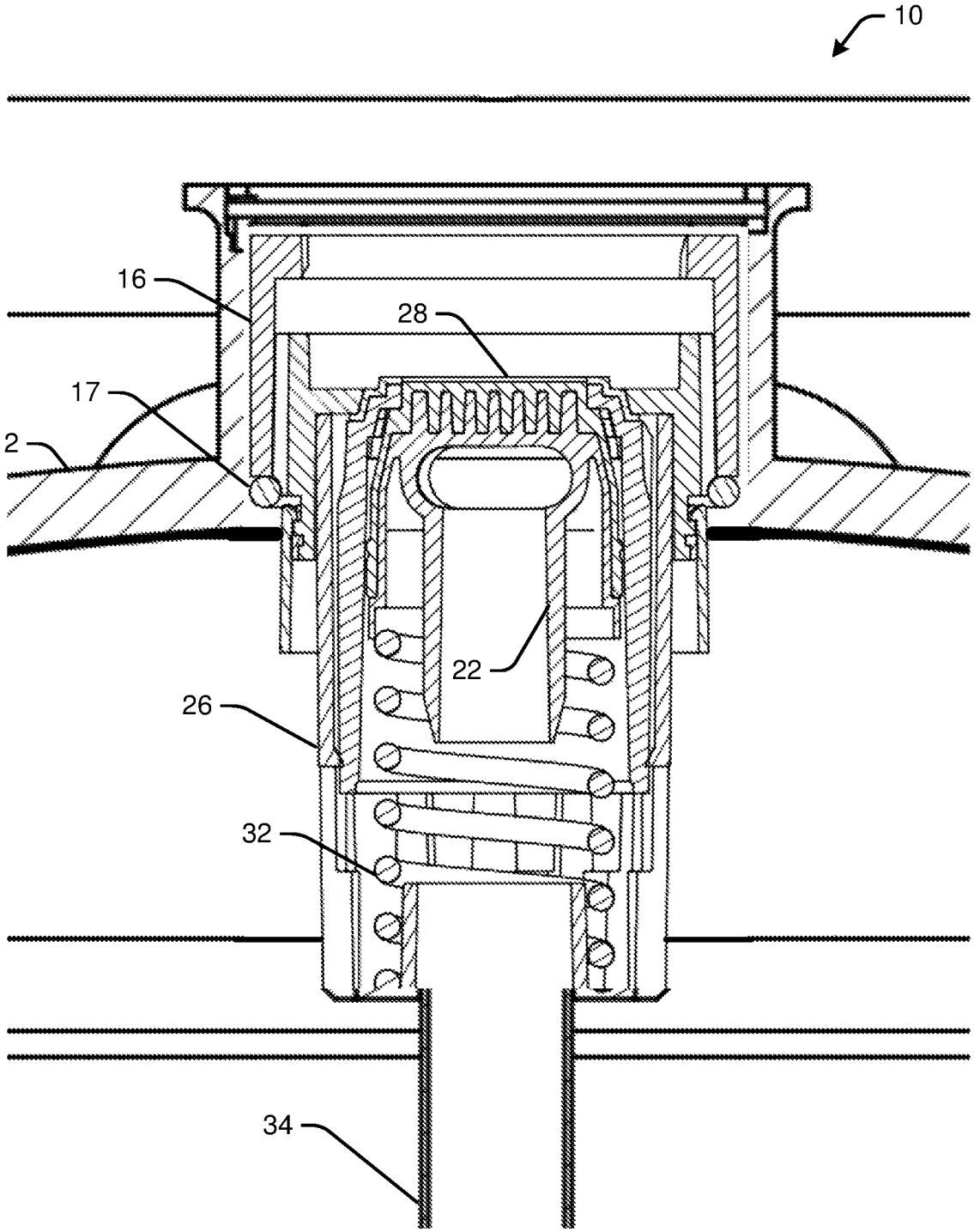
FIG. 3 is a close-up cross-sectional view of the example device for providing a disposable liner or bag and valve inside of a keg or other container as it may be inserted through a top opening of a keg.

FIG. 3 is a close-up partial cross-sectional view of the example device 10 for providing a disposable liner or bag 1 (see, e.g., FIG. 1) and valve inside of a keg 2 or other container as it may be inserted through a top opening of a keg. In FIG. 3 it can be seen that a matched geometry seat is overmolded to seal against the secondary valve seal 20 for the secondary valve 18 and seals against the body 16. The dispensing tube 34 connects through the bag fitment 28, the cage 26, and onto the poppet valve 22.

In an example, the dispensing tube 34 is pressed (male/female interference fit) to a tapered boss on the bottom portion of the poppet valve 22. Other fitments are also contemplated (e.g., the tube may be threaded onto the poppet). The secondary valve 18 is then inserted over the poppet valve 22 until the overmolded upper seal 24*a* of the poppet valve 22 conforms snugly into the opening at the top of the secondary valve 18.

In an example, the spring 32 is assembled over an inner-diameter spring retainer formed in the lower portion of the cage 26. The valve assembly 12 is then inserted into the cage 26 in a downward direction while installing the poppet valve 22 onto the free end of the spring 32, and is secured via a plastic deformation snap fit.

The cage 26 includes internal snaps that interact to overcome the major diameter of the flange formed on the body of the secondary valve 18, thereby retaining the secondary valve 18, poppet valve 22, dispensing tube 34 and spring 32 in place inside the cage 26. In another example, the cage may be permanently adhered to the body, e.g., via spin welding. The assembly of the poppet, tube, secondary valve, spring and cage as just described, is then inserted into the bottom side of the body 16 and mechanically connected to an internal diameter groove present in the lower section of the body 16.

The liner or bag 1 has a pre-bonded fitment which is then installed (via the mouth of the bag and fitment) over the dispensing tube 34 and inserted into the bottom side of the body 16. This is retained via a plastic deformation type snap fit clips of the bag fitment into the body of the Sankey coupler.

In an example, the valve assembly 12 is connected to a top opening of the keg 1 or other container and may serve as a double actuation valve. As used herein, the term "double actuation" refers to use of a gas to first expand the liner or bag 1, and then fill the liner or bag 1 installed in the keg 2 with beer or other liquid.

Vent openings in the valve assembly 12 may be open to outside air. In an example, vent openings are formed in the valve assembly 12 to enable air outside of the disposable liner or bag 1 to enter or exit a confined volume within the keg 2 or other container. This plurality of valves and passages in the valve assembly 12 enable an inert gas to be flowed into the disposable liner or bag 1 to expand the disposable liner or bag 1 inside of the keg 2 or other container. The keg 2 or other container can then be filled with alcohol or other liquid for dispensing. When the keg 2 or other container is empty, the spear assembly is disconnected from the top opening of the keg 2 or other container, and the device 10 can be withdrawn from the keg 2 or other container to remove the disposable liner or bag 1 after the gas pressure is relieved.

In an example, the techniques described herein for providing the liner or bag 1 into the keg help reduce or altogether eliminate oxygen getting into the liquid. This helps slow or even prevent the growth of bacteria. Specifically, when the liner or bag 1 is rolled over the dispensing tube 34, this action has a tendency to squeeze air out of the liner or bag 1. Then, when the liner or bag 1 is connected to the valve assembly (using the fitment) the assembled liner or bag 1, air is prevented from coming in or out because the valves are in a normally closed position by the spring until such time as the inert gas is connected for filing the liner or bag as described below. As such, the liner or bag 1 has little or no air prior to use (e.g., during shipment, storage, and setup), and even when it is inflated by the CO2 gas, it still has little or no air during the filling process.

Figure 4:
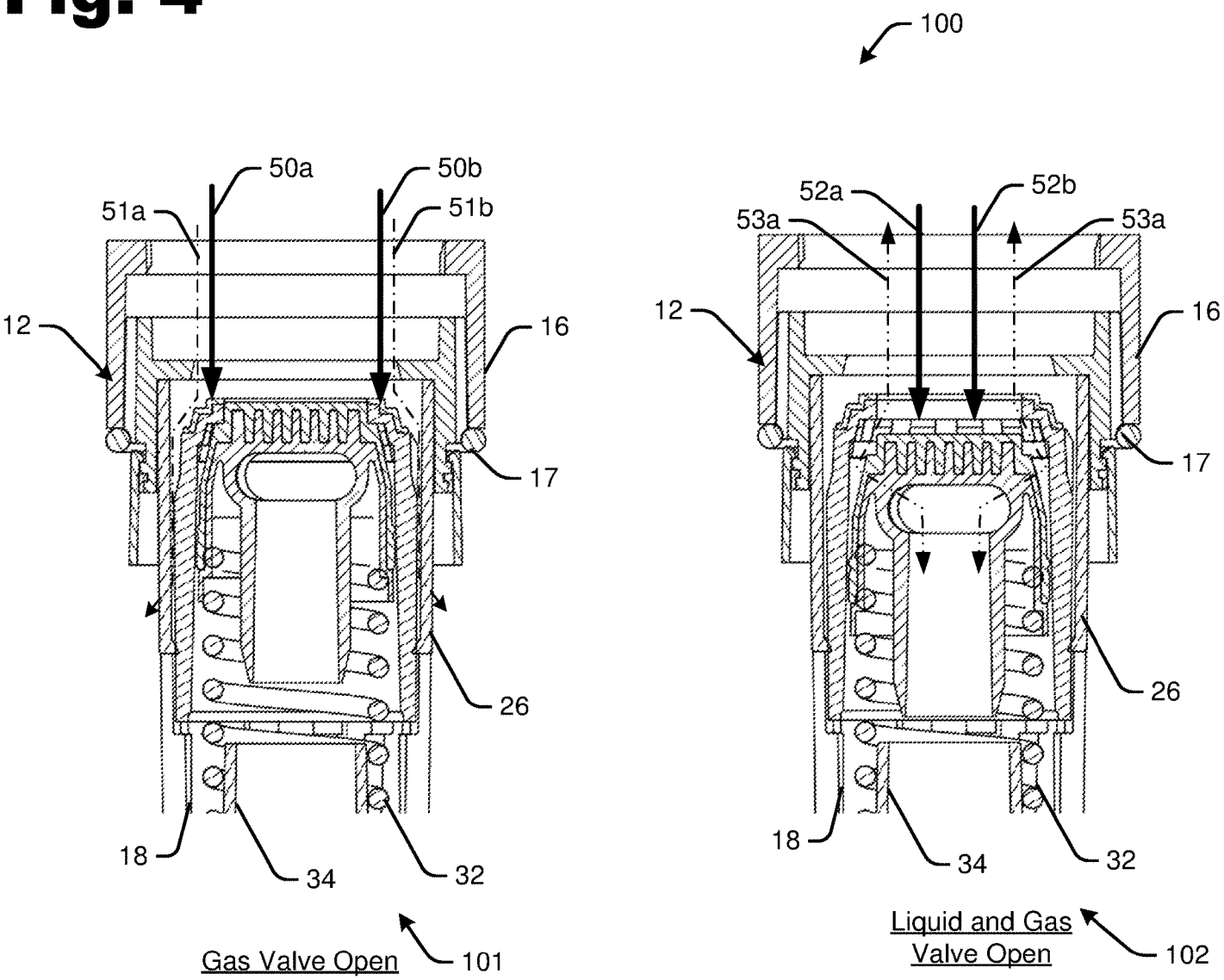
FIG. 4 illustrates example double actuation operation of the valve assembly.

FIG. 4 illustrates example double actuation operation 100 of the valve assembly 12 (see also, e.g., FIG. 3). In operation, the gas and beer valves of the valve assembly 12 are initially closed to the outside atmosphere and the appropriate style beer tap is installed into the upper section of the Sankey coupler.

In operation 101, the gas valve is open to the outside atmosphere. When a lever arm on the beer tap is actuated, a stepped plunger is forced onto the upper surfaces of both the secondary valve 18 and the poppet valve 22. This lever action creates two separate, but timed responses of the valve assembly 12. The primary plunger presses down against the upper surface of the secondary valve, whilst the secondary plunger acts on the upper seal of the poppet valve (illustrated by arrows 50*a-b*). This action initially (due to plunger travel) actuates the secondary valve 18, allowing inert gas (illustrated by arrows 51*a-b*) under pressure as provided by the tap to occupy the head space within the liner or bag 1, which in turn builds pressure within the liner or bag 1.

In operation 102, both the gas valve and the beer valve are open to the outside atmosphere. During the lever arm actuation, the liquid plunger of the beer tap presses (illustrated by arrows 52*a-b*) on the upper seal 24*a* of the poppet valve 22 forcing the poppet valve 22 down against pressure of the spring 32. This permits both (illustrated by double-ended arrows 53*a-b*) filling the keg with beer or other liquid, and dispensing of pressurized beer or other liquid through the dispensing tube 34 and up through the poppet valve 22 into the receiving valve on the tap and refilling the void created in the keg with inert gas.

Figure 5:
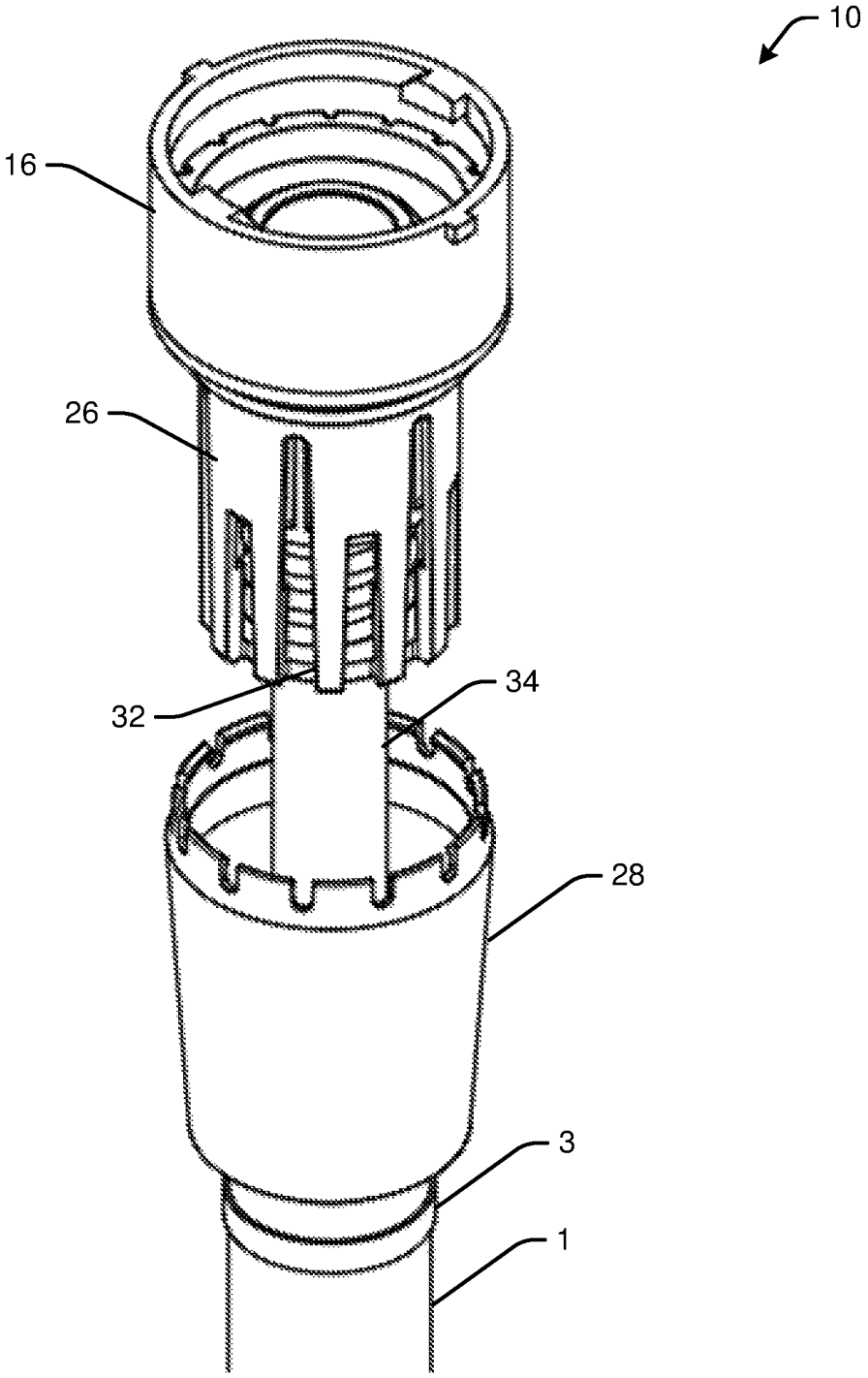
FIG. 5 illustrates attachment of a keg liner or bag to a spear of the example device for providing a disposable liner or bag and valve inside of a keg or other container.
Figure 6:
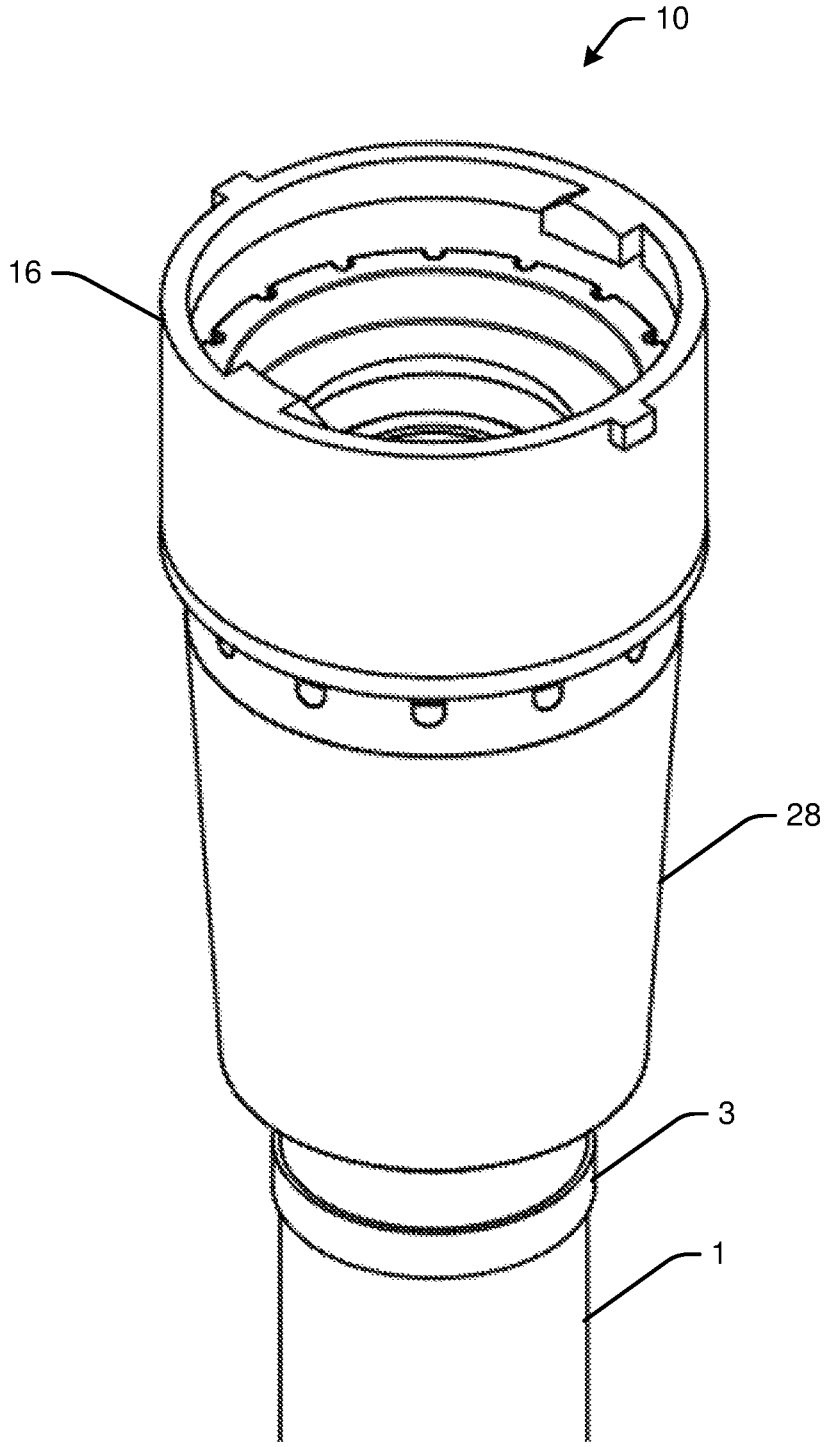
FIG. 6 shows the assembled view from FIG. 5.
Figure 7:
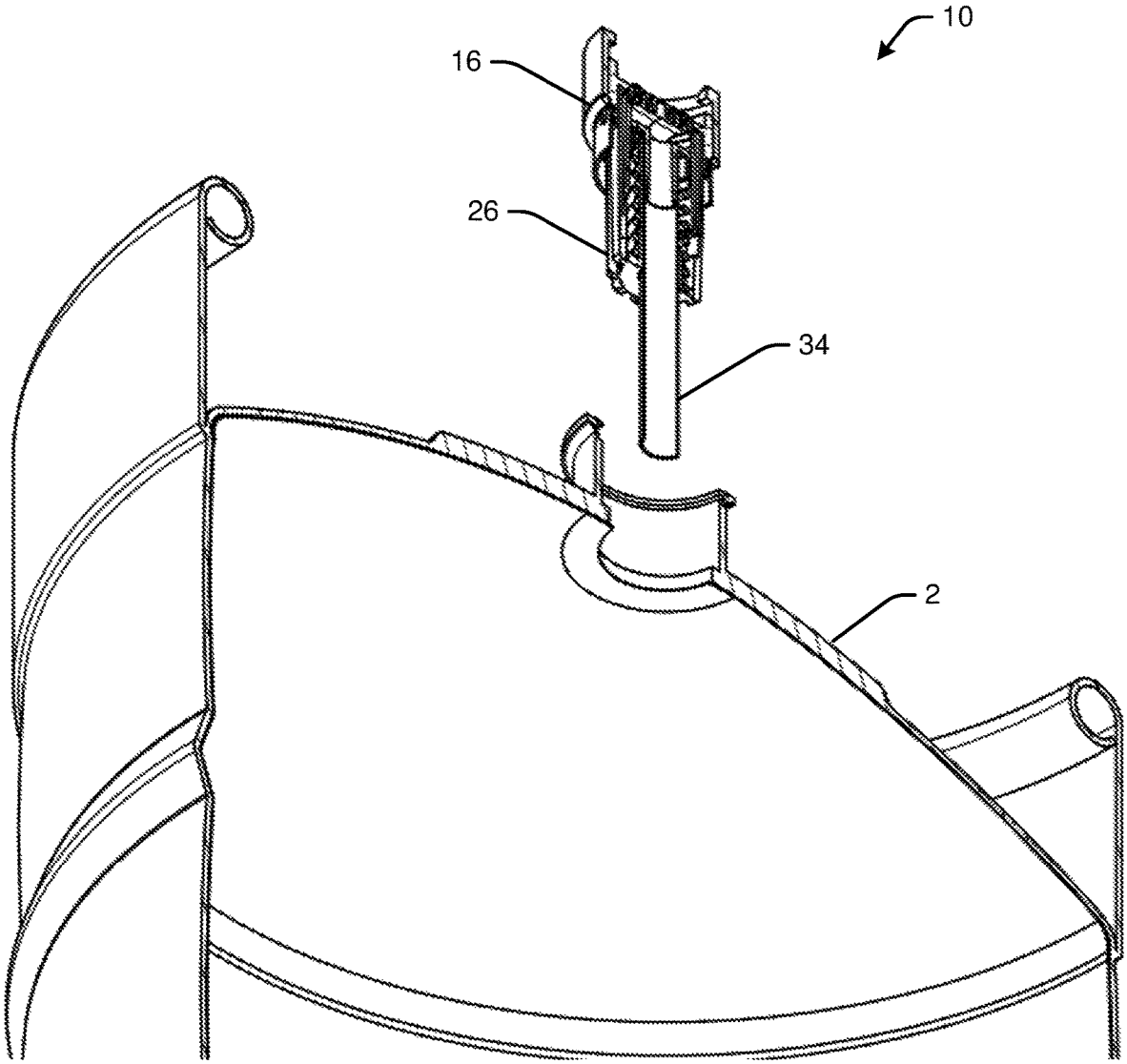
FIGS. 7-10 illustrate the example device as it may be implemented to provide a disposable liner or bag and valve inside of a keg or other container.
Figure 8:
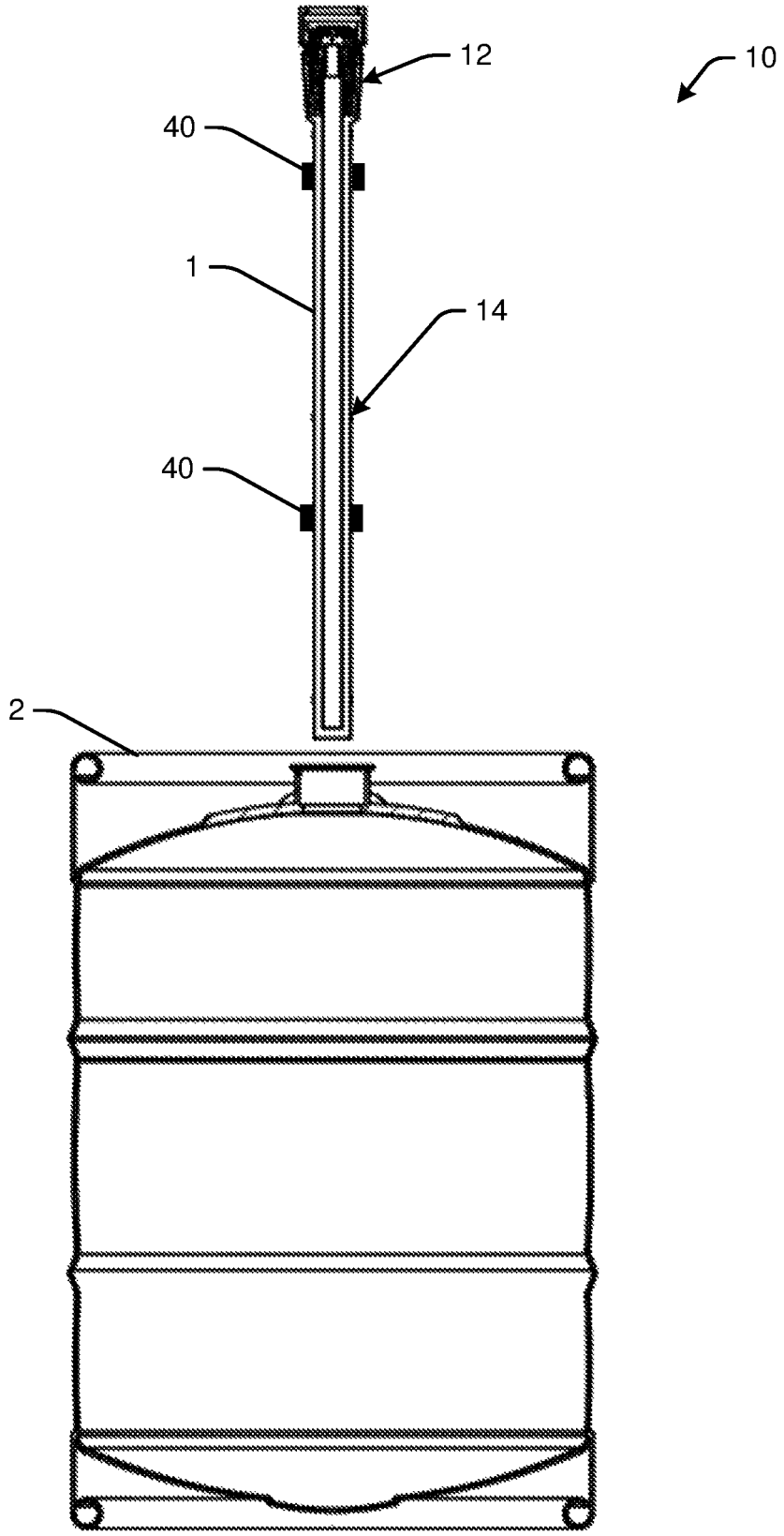
Figure 9:
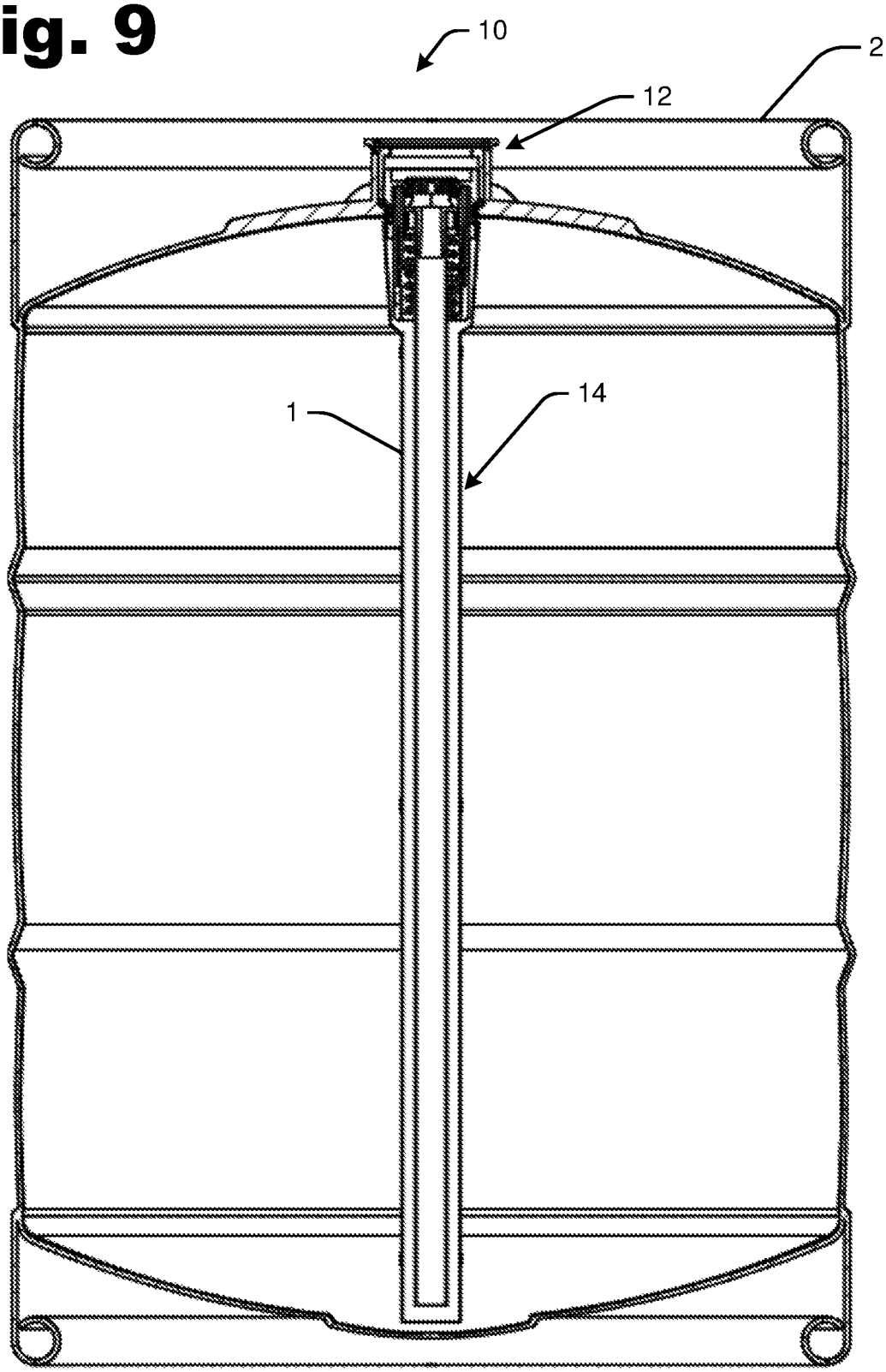

FIG. 5 illustrates attachment of a liner or bag 1 to the example device 10 for providing a disposable liner or bag 1 and valve inside of a keg 2 or other container. FIG. 5 illustrates attachment of a keg liner or bag to a spear of the example device for providing a disposable liner or bag 1 and valve inside of a keg or other container. FIG. 6 shows the assembled view from FIG. 5. In an example, the liner or bag 1 has a banding or fitment 3 sealed to it to connect to the valve assembly 12. In another example, the liner or bag 1 need not be provided separately (e.g., for attachment to the valve assembly 12). Instead, the liner or bag 1 and valve assembly 12 may be purchased and used together as a unit.

In this example, the overmolded seal 30 provided around the circumference of the body 16 of the bag fitment creates a seal between the liner or bag 1 and the Sankey coupler to eliminate leaks between the liquid and the air gap in the surrounding keg structure. The liner or bag 1 can be rolled around the circumference of the dispensing tube 34 and retained via plastic clips these clips are manually pulled off before the bag gets fully inserted in the keg 3 to maintain a minimal outer diameter of the liner or bag 1 during installation into the opening of the keg 2. After the liner or bag 1 is inflated, the retainers automatically release and allow the liner or bag 1 to expand to a conformance diameter equal to or greater than the inside diameter of the shell of the keg 2. In an example, over-sizing of the top and bottom material accommodates the top and bottom domes. See, e.g., FIG. 12 for another example retainer.

FIGS. 7-10 illustrate the example device 10 as it may be implemented to provide a disposable liner or bag 1 and valve inside of a keg 2 or other container. In an example, the components and connections depicted in the figures may be used for the example operations implemented to provide the disposable liner or bag 1 and valve inside of the keg 2. It is noted that the operations illustrated may be reversed to remove the disposable liner or bag 1 from the keg 2 after use.

In an example of the device for providing a disposable liner or bag 1 and valve inside of a keg 2 or other container, the valve assembly 12 may connect to a spear assembly 14. The spear assembly 14 may be connected to the dispensing tube 34. In another example, the spear assembly 14 may be formed as a part of the dispensing tube 34.

The disposable liner or bag is provided on the spear assembly 14. For example, the disposable liner or bag 1 may be wrapped or otherwise folded on or around the spear assembly 14. This enables the liner or bag 1 to fit through the top opening of the keg 2 and be inserted down into the keg 2.

In an example, fitment 3 (FIG. 5) and additional retainers 40 maintain the disposable liner or bag 1 in a closed configuration until the liner or bag 1 is inflated. Inflating the liner or bag 1 causes the plastic strips 40 to elongate and rupture so that the disposable liner or bag 1 fully deploys within the keg 2 or other container. By way of illustration, retainers 40 may be clips or strips (e.g., thin strips of "dry-cleaner" gage plastic with adhesive pads at both ends) are provided around the liner or bag 1 after wrapping it to the dispensing tube 34 to secure the liner or bag 1 with a reasonably tight wrap so that it can be readily stored, transported, and inserted into the keg 2. When the liner or bag 1 is inflated, the plastic strips release (e.g., break) to enable the liner or bag 1 to fully deploy within the keg 2. See, e.g., FIG. 12 for another example retainer.

After inserting the liner or bag 1 into the keg 2, the valve assembly 12 is secured to the top opening of the keg 2. Once inside the keg 2, the valve assembly 12 is connected or "locked" with an on the top opening of the keg 2. In an example, the o-ring 17 does not provide an airtight seal. Instead, the valve and bag fitment seals maintain an airtight connection with the keg 2. The o-ring 17 enables installation of the valve assembly 12 against a machined seat inside the bung neck, which when coupled, creates an elastic deformation pressure, which forces the uppermost face of the valve body 16 against the underside of a circlip retaining ring or circlips or snap retainer rings shipped new with every insert (faster in and out and cleaner (new every time)) which also resides inside the neck of the bung. This enables high pressure gas filling and dispensing operations. It is noted that other examples are also contemplated (e.g., without the o-ring).

Once inside the keg 2, the disposable liner or bag 1 may be filled with beer or other liquid to be dispensed from the keg 2. In an example, the keg valve is operated to fill the keg 2 with the liner or bag 1 installed. As described above with reference to FIG. 4, an example filling process comprises two steps. The first step is to fill the keg 2 with inert gas under pressure, which also inflates the liner or bag 1. A series of valves and passages of the valve assembly 12 enable an inert gas (e.g., carbon dioxide) to flow into and expand or inflate the disposable liner or bag 1 inside of the keg 2. The second step is to fill the keg 2 with beer (or other liquid) through the gas valve. The extra carbon dioxide is bled off through the dispensing valve.

The beer or other liquid can be dispensed from the keg 2 or other container by operation of the valve assembly 12. When the keg 2 is empty, the spear assembly may be disconnected from the top opening of the keg 2 and withdrawn, thus removing the disposable liner or bag 1 from the keg 2.

The operations shown and described herein are provided to illustrate example implementations. It is noted that the operations are not limited to the ordering shown. Still other operations may also be implemented.

Figure 11:
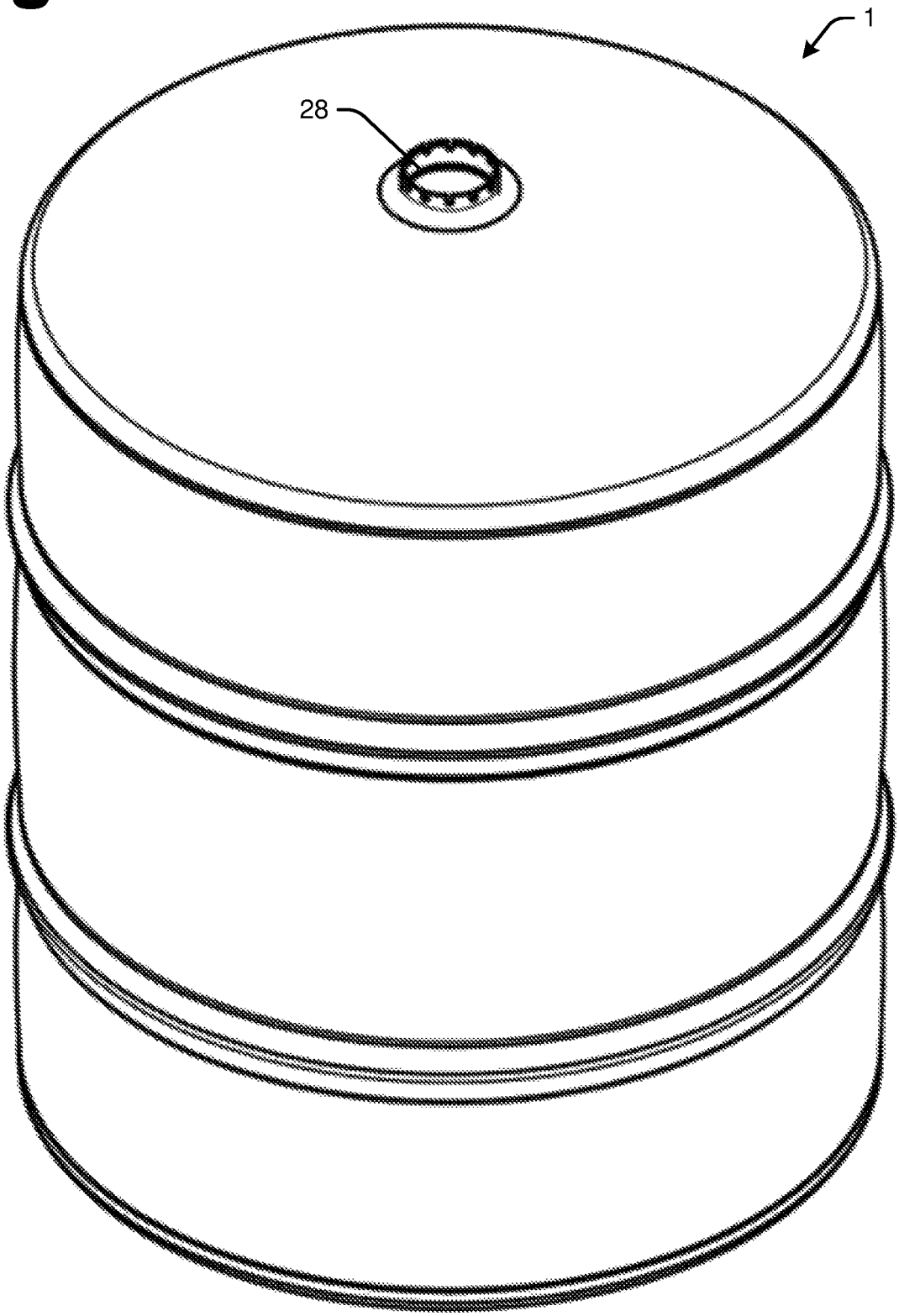
FIG. 11 shows an example disposable liner or bag that may be provided inside of a keg or other container by the example device disclosed herein.

FIG. 11 shows an example disposable liner or bag 1 that may be provided inside of a keg 2 or other container by the example device 10 disclosed herein. In FIG. 11, the liner or bag 1 is illustrated in a fully expanded configuration, e.g., as it would be after installation in the keg 2. In an example, the liner or bag 1 is designed to be of sufficient volume to conform to the inside structure of the keg 2. The disposable liner or bag 1 may be made of food-grade plastic or other suitable material that can be readily inserted through the top opening of the keg 2, and then expanded within the keg 2 for filling with beer or other liquid. Although the liner or bag 1 may be re-used, in an example the liner or bag 1 (and even the valve assembly 12) is preferably disposed of to remove the need for cleaning and reduce the growth of bacteria.

Figure 12:
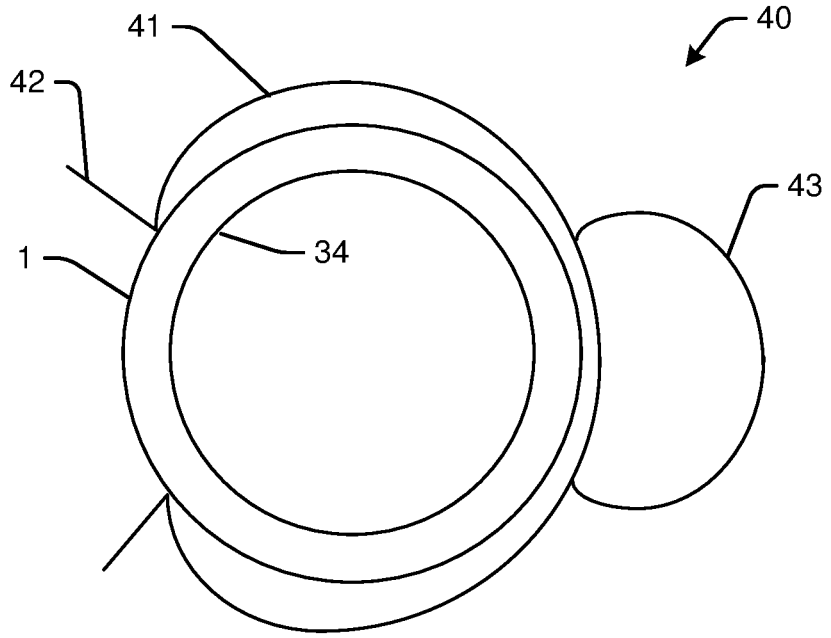
FIG. 12 is a cross-sectional view through the dispensing tube with the disposable liner or bag wrapped around and held in place by an example retainer.

It is noted that any suitable retainer may be implemented (e.g., even rubber bands). FIG. 12 is a cross-sectional view through the dispensing tube 34 with the disposable liner or bag 1 wrapped around and held in place by an example retainer 40. In an example, the retainer 40 may be an inexpensive and simple plastic clip 41 with arms 42 to enable pressing the clip over the tube 34, and pull-tab 43 for easy removal. After factory liner wrapping, workers may add 2 to 3 clips per insert. The design is such that a pull-tab 43 may extend out far enough that the clip 41 and clip arms 42 with tap would not fit through the keg neck during insertion. So, as the insert is loaded, the retainers 40 are pulled off and discarded. At that point, if the liner 1 begins to unwind a little from the tube 34, the liner is already inside the keg and it won't affect installation.

It is noted that the examples shown and described are provided for purposes of illustration and are not intended to be limiting. Still other examples are also contemplated.

The invention claimed is:

1. A device for providing a disposable liner or bag and valve inside of a keg or other container, comprising:

a dispensing tube;

a spear assembly;

a disposable liner or bag provided on the spear assembly; wherein the disposable liner or bag is wrapped or otherwise folded on or around the spear assembly so that the liner or bag fits through a top opening of a keg and can be inserted therethrough;

a double actuation valve assembly having a valve body, a poppet valve, a secondary valve, and a cage mounted over the secondary valve, the secondary valve opens a gas passage and surrounds the poppet valve, and the poppet valve opens a liquid passage, the spear assembly connected to the double actuation valve assembly;

a spring housed between the cage and the poppet valve, and providing a biasing force for both the poppet valve and the secondary valve;

a stepped plunger having a primary plunger and a secondary plunger, the primary plunger surrounding the secondary plunger;

wherein the double actuation valve assembly operates in a first mode with the secondary valve opening the gas passage, the primary plunger pressing against an upper surface of the secondary valve and acting against the biasing force of the spring, the poppet valve moves with the secondary valve but remains closed, allowing inert gas under pressure to occupy a head space within the disposable bag to build pressure within the disposable liner or bag; and wherein the double actuation valve assembly operates in a second mode with both the secondary valve and the poppet valve are actuated opening the gas passage and the liquid passage to the outside atmosphere, the secondary plunger extending further into the valve body than the primary plunger and pressing on an upper seal of the poppet valve to force the poppet valve down further against the biasing force of the spring so that both filling the disposable liner or bag with liquid, and dispensing of pressurized liquid through the dispensing tube and up through the poppet valve into a receiving valve on a tap refills a void created in the disposable liner or bag.

2. The device of claim 1, further comprising fitting a sankey coupler to the valve body of the double actuation valve assembly to provide a valve interface operable from outside of the keg or other container.

3. The device of claim 1, further comprising a matched seat seals against a secondary valve seal for the secondary valve.

4. The device of claim 1, further comprising a matched seat seal inside the secondary valve.

5. The device of claim 4, wherein the matched seat seal includes an upper and lower seal.

6. The device of claim 5, further comprising a lower seal of the poppet valve between the inner diameter of the secondary valve and the outside diameter at the poppet valve.

7. The device of claim 1, further comprising a bag fitment.

8. The device of claim 7, further comprising the spring housed between the cage and the poppet valve adjacent the bag fitment.

9. The device of claim 8, wherein the dispensing tube connects through the bag fitment, the cage, and onto the poppet valve.

10. The device of claim 9, further comprising a bag fitment seal.

11. The device of claim 10, wherein the disposable liner or bag connects to the bag fitment.

12. The device of claim 1, further comprising at least one retainer to maintain the disposable liner or bag in a closed configuration on the spear assembly.

13. The device of claim 1, further comprising vent openings formed in the valve assembly to enable air on an outside of the disposable liner or bag to enter or exit a confined volume within the keg or other container.

14. The device of claim 12, wherein the vent openings are open to outside air.

15. The device of claim 1, wherein the poppet valve, the secondary valve, the gas passage, and the liquid passage in the double actuation valve assembly enable an inert gas to be flowed into the disposable liner or bag to expand the disposable liner or bag inside of the keg or other container.

16. The device of claim 15, wherein the poppet valve, the secondary valve, the gas passage, and the liquid passage in the double actuation valve assembly enable the inert gas to escape as a beverage or other liquid is flowed into the disposable liner or bag inside of the keg or other container.

17. The device of claim 1, wherein the double actuation valve assembly is connected to a top opening of the keg or other container.

18. The device of claim 17, wherein when the keg or other container is empty, the spear assembly is disconnected from the top opening of the keg or other container, and the spear assembly is withdrawn from the keg or other container to remove the disposable liner or bag after the gas pressure is relieved.

* * * * *